United States Patent [19]

Sprecker et al.

[11] Patent Number: 4,464,291

[45] Date of Patent: Aug. 7, 1984

[54] PROCESS FOR ENHANCING OR AUGMENTING THE AROMA OF PERFUME COMPOSITIONS, COLOGNES AND PERFUMED ARTICLES USING NORBORNYL DIESTERS

[75] Inventors: Mark A. Sprecker, Sea Bright; Patrick Whelan, Matawan, both of N.J.

[73] Assignee: International Flavors & Fragrances Inc., New York, N.Y.

[21] Appl. No.: 492,038

[22] Filed: May 5, 1983

[51] Int. Cl.[3] ..... C11B 9/00

[52] U.S. Cl. ..... 252/522 R

[58] Field of Search ..... 252/522 R

[56] References Cited

U.S. PATENT DOCUMENTS 4,143,065 3/1979 Hoffmann et al. ..... 252/522 R 4,357,253 11/1982 Klemarezyk et al. ..... 252/174.11

OTHER PUBLICATIONS

Soulier et al., "Bull. Soc. Chin. Fr.", (1975), (7-8, Pt 2), pp. 1763-1766.

*Primary Examiner*—Anton H. Sutto

*Attorney, Agent, or Firm*—Arthur L. Liberman

[57] ABSTRACT

Described are norbornyl diesters defined according to the structure:

wherein $R_1$ and $R_2$ are the same or different, $C_1$–$C_3$ lower alkyl; wherein one of $R_3$, $R_4$, $R_5$, $R_6$ and $R_7$ is methyl and the other of $R_3$, $R_4$, $R_5$, $R_6$ and $R_7$ is hydrogen; and wherein the dashed line represents a carbon-carbon single bond or a carbon-carbon double bond for use in augmenting or enhancing the aroma of perfume compositions, colognes and perfumed articles including solid or liquid anionic, cationic, nonionic or zwitterionic detergents, fabric softener compositions, fabric softener articles, shampoos and other hair preparations as well as perfumed polymers, e.g., perfumed polyethylene.

12 Claims, 7 Drawing Figures

GLC PROFILE FOR INITIAL REACTION SAMPLE OF EXAMPLE II (A). CRUDE

GLC PROFILE FOR EXAMPLE I. CRUDE

GLC PROFILE FOR EXAMPLE II (B). CRUDE

GLC PROFILE FOR EXAMPLE II (A). CRUDE

GLC PROFILE FOR EXAMPLE III.
CRUDE

FIG.6
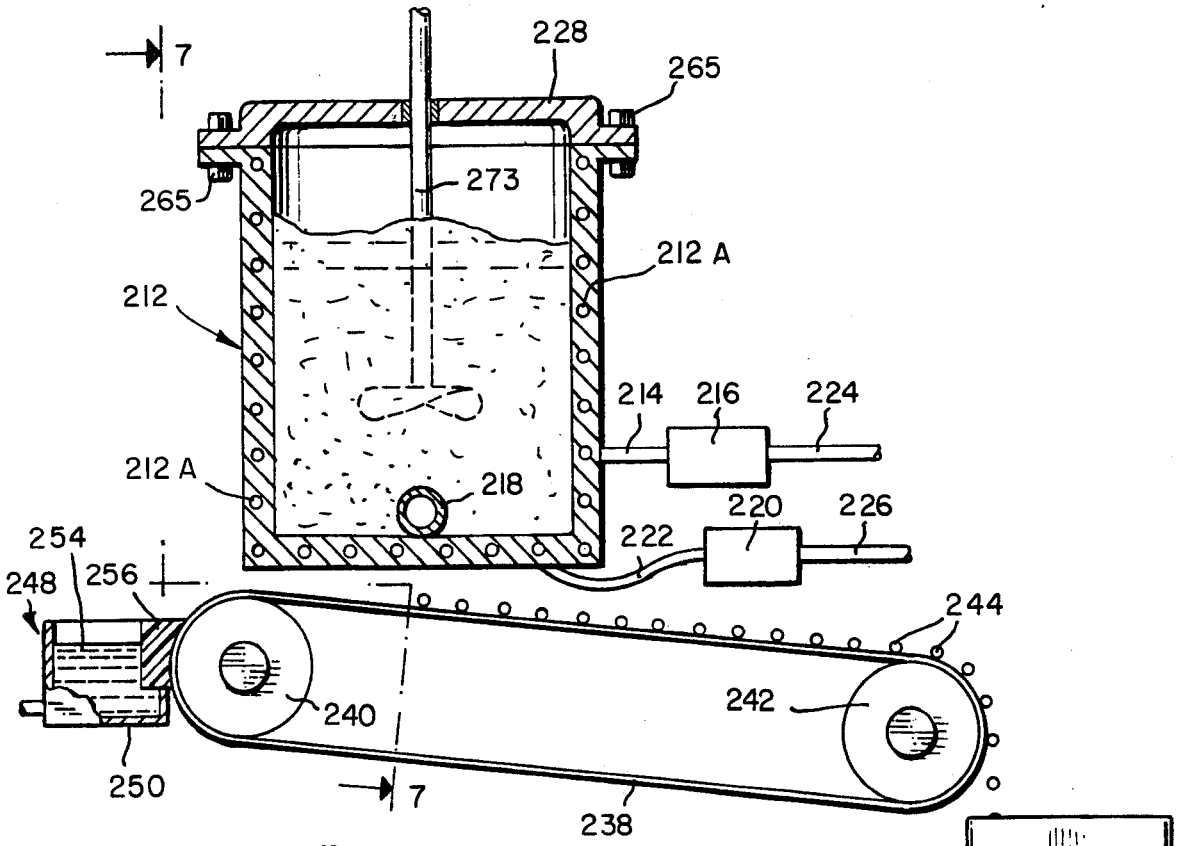
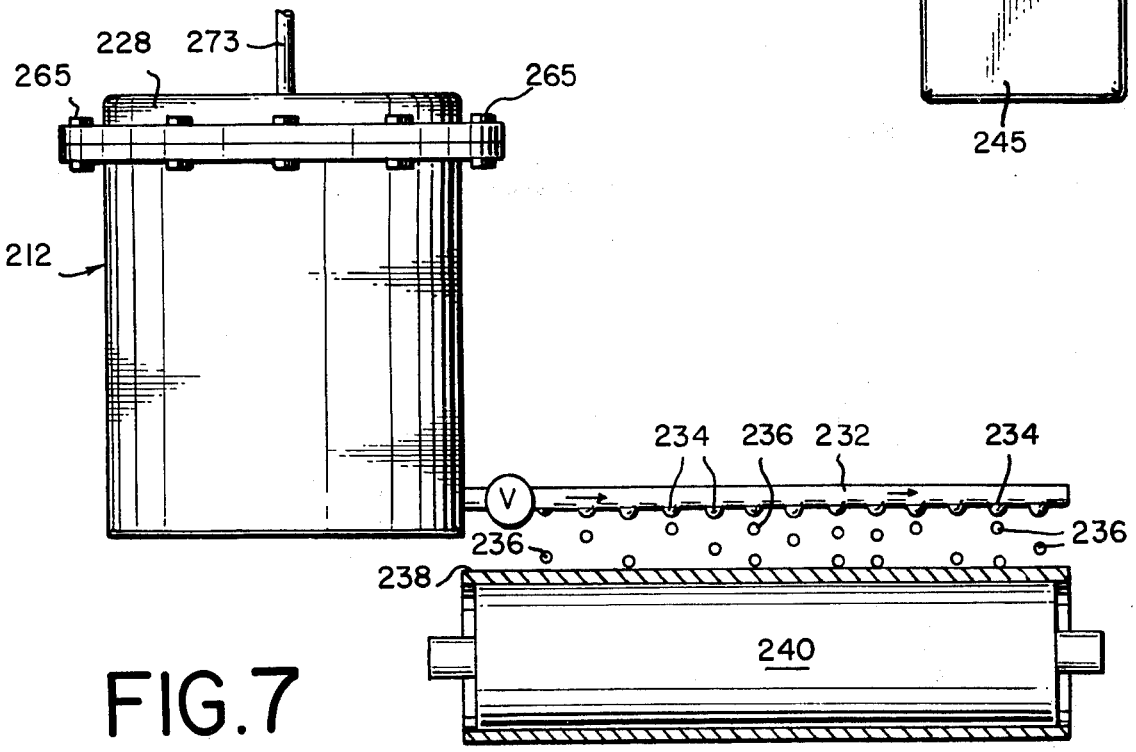
FIG.7

PROCESS FOR ENHANCING OR AUGMENTING THE AROMA OF PERFUME COMPOSITIONS, COLOGNES AND PERFUMED ARTICLES USING NORBORNYL DIESTERS

BACKGROUND OF THE INVENTION

This invention relates to the norbornyl diesters defined according to the structure:

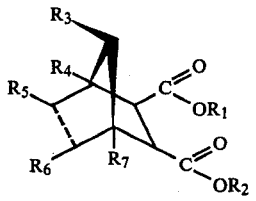

wherein $R_1$ and $R_2$ are the same or different, $C_1$–$C_3$ lower alkyl; wherein one of $R_3$, $R_4$, $R_5$, $R_6$ and $R_7$ is methyl and the other of $R_3$, $R_4$, $R_5$, $R_6$ and $R_7$ is hydrogen; and wherein the dashed line represents a carbon-carbon single bond or a carbon-carbon double bond; enhancing the aroma of perfume compositions, colognes and perfumed articles.

There has been considerable work performed relating to substances which can be used to impart (modify, augment or enhance) fragrances to (or in) various consumable materials. These substances are used to diminish the use of natural material, some of which may be in short supply, and to provide more uniform properties in the finished product.

Earthy, green, cucumber, violet, spicy (peppery), woody, fruity, floral, tropical rain forest-like, morning dew aroma with patchouli, camphoraceous, clove-like, caryophyllene and carnation nuances on a dry-out.

U.S. Pat. No. 4,357,253 discloses norborynl esters defined according to the structure:

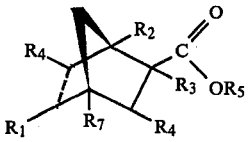

for use in augmenting or enhancing the aroma of perfume compositions, colognes and perfumed articles wherein the dashed line represents either a carbon-carbon single bond on a carbon-carbon double bond; $R_1$, $R_2$, $R_3$, $R_4$, $R_6$ and $R_7$ represents hydrogen or methyl; with the proviso that one of $R_1$, $R_2$, $R_6$ and $R_7$ is methyl and each of the other of $R_1$, $R_2$, $R_6$ and $R_7$ is hydrogen; and with the further proviso that $R_3$ and $R_4$ are not both methyl.

Norbornyl carboxylic acid diesters defined according to the structure:

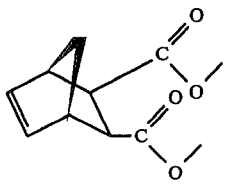

are known compounds as disclosed in Chemical Abstracts, Vol. 98, 1983, at Abstract No. 88786t (abstract of "Tetrahedron Letters, 1982, 23 (36) 3683–3686". Such diesters are well known in the prior art.

However, nothing in the prior art discloses the use of the norbornyl diesters of our invention for use in augmenting or enhancing the aroma of perfume compositions, perfumed articles, and colognes.

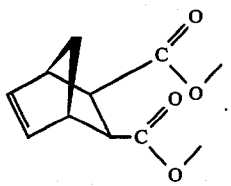

Figure 2:
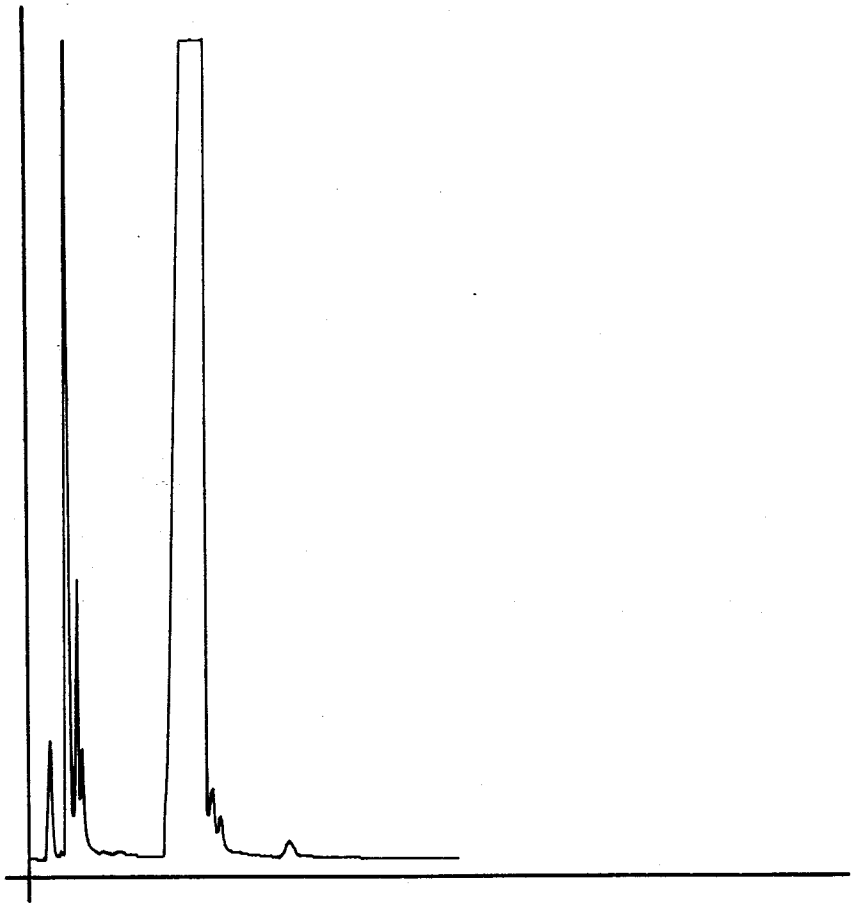

FIG. 2 is the GLC profile for the crude reaction product of Example II-A (initial reaction sample) containing the compound having the structure:

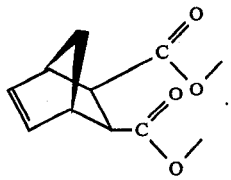

Figure 3:
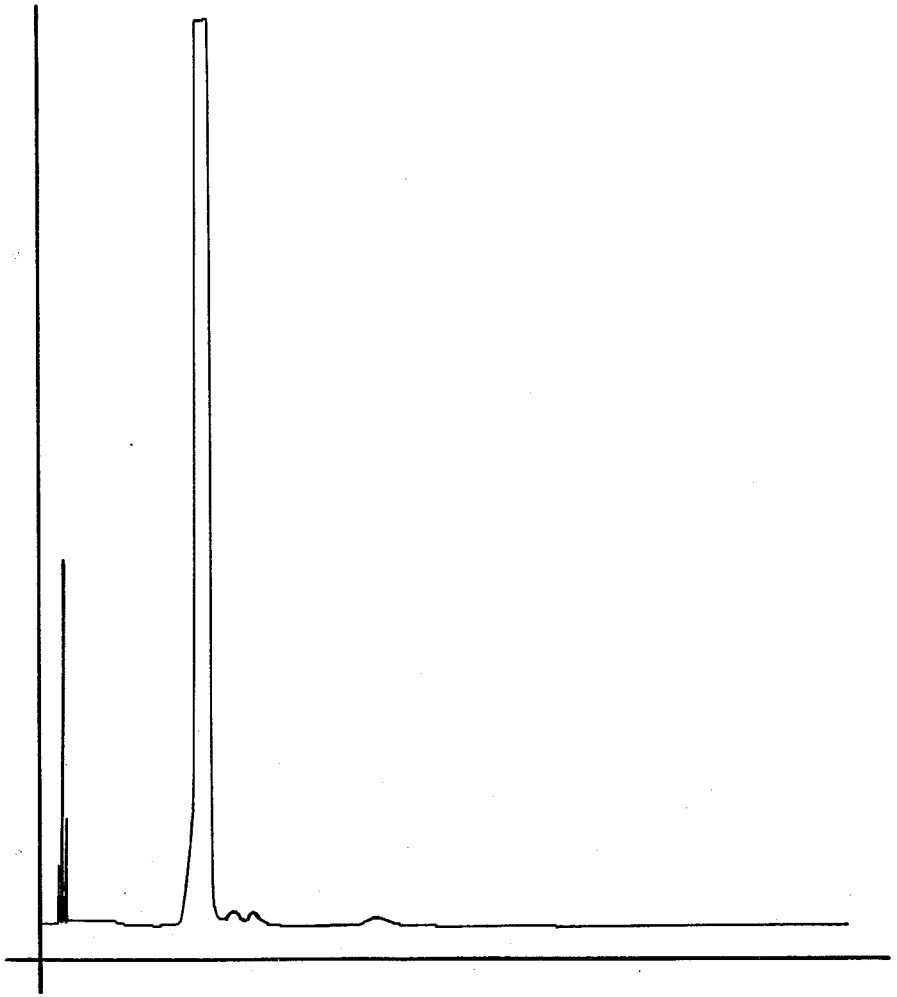

FIG. 3 is the GLC profile for the crude reaction product of Example II-A prior to subsequent reaction in Example II-B, containing the compound having the structure:

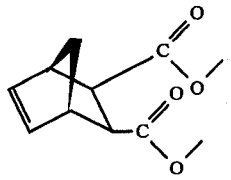

Figure 4:
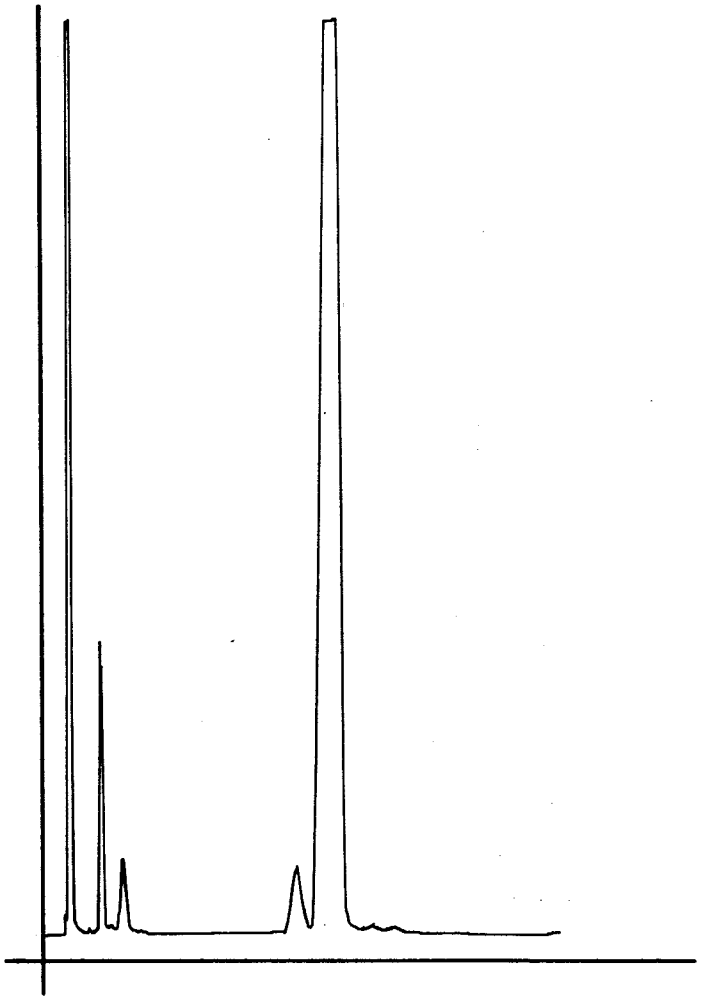

FIG. 4 is the GLC profile for the crude reaction product of Example II-B containing the compound having the structure:

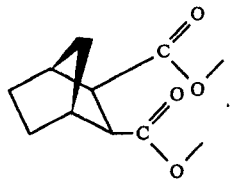

Figure 5:
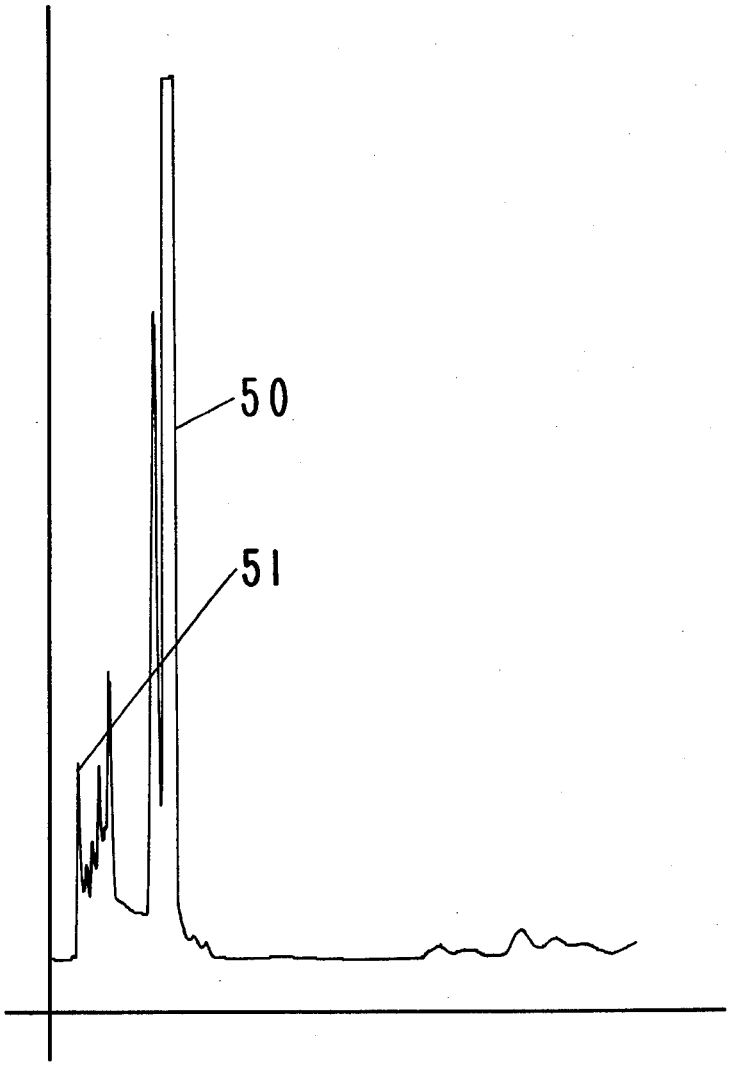

FIG. 5 is the GLC profile for the crude reaction product of Example III containing a mixture of compounds defined according to the structure:

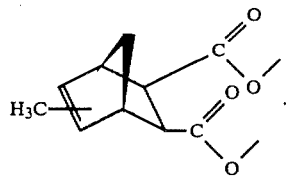

FIG. 6 represents a cut-away side elevation view of apparatus used in forming perfumed polymers containing at least one of the compounds defined according to the structure:

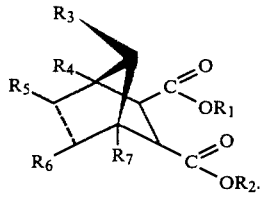

wherein $R_1$ and $R_2$ are the same or different, $C_1$–$C_3$ lower alkyl; wherein one of $R_3$, $R_4$, $R_5$, $R_6$ and $R_7$ is methyl and the other of $R_3$, $R_4$, $R_5$, $R_6$ and $R_7$ is hydrogen; and wherein the dashed line represents a carbon-carbon single bond or a carbon-carbon double bond.

FIG. 7 is a front view of the apparatus of FIG. 6 looking in the direction of the arrows.

DETAILED DESCRIPTION OF THE DRAWINGS

Figure 1:
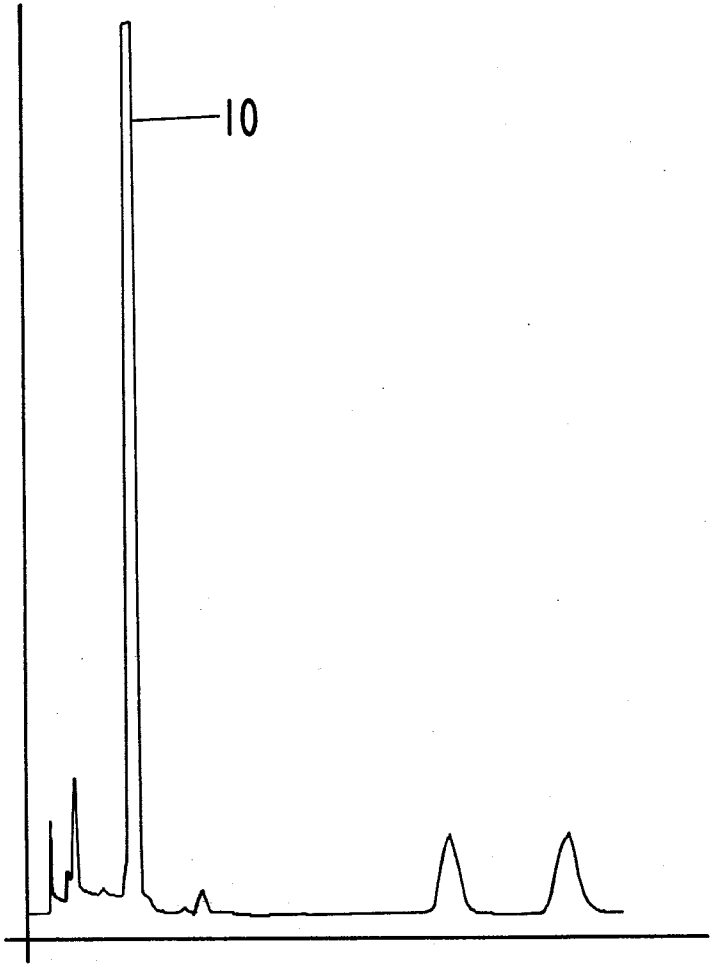
FIG. 1 is the GLC profile for crude reaction product of Example I containing the compound having the structure.

FIG. 1 is the GLC profile for the crude reaction product of Examle I prior to distillation. The peak indicated by reference numeral "10" is the peak for the compound having the structure:

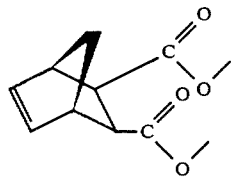

(conditions: SE 30 column programmed at 220° C. isothermal).

FIG. 5 is the GLC profile for the crude reaction product containing a mixture of compounds defined according to the structure:

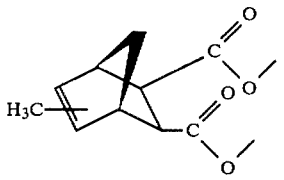

wherein in the mixture in each of the molecules, the methyl moiety bonded to the norbornyl ring is at a different position on said norbornyl ring.

Referring to FIGS. 6 and 7, there is provided a process for forming scented polymer elements (wherein the polymer may be thermoplastic polymers such as low density polyethylene or polypropylene or copolymers of ethylene-vinyl acetate or mixtures of polymers and copolymers such as copolymers of ethylene-vinyl acetate and polyethylene) such as pellets useful in the formation of plastic particles useful in fabricating certain articles which may be perfumed. This process comprises heating the polymer or mixture of polymers to the melting point of said polymer or mixture of polymers, e.g., 250° C. in the case of low density polyethylene. The lower most portion of the container is maintained at a slightly lower temperature and the material of the container is taken off at such location for delivery through the conduit. Thus, referring to FIGS. 6 and 7, in particular, the apparatus used in producing such elements comprises a device for forming the polymer containing perfume, e.g., polyethylene or polyethylene-polyvinyl acetate or mixtures of same or polypropylene, which comprises a vat or container 212 into which the polymer taken alone or in admixture with other copolymers and the perfuming substance defined according to the structure:

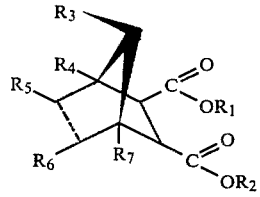

is placed. The container is closed by means of an air-tight lid 228 and clamped to the container by bolts 265. A stirrer 273 traverses the lid or cover 228 in an air-tight manner and is rotatable in a suitable manner. A surrounding cycliner 212A having heated coils which are supplied with electric current through cable 214 from a rheostat or control 216 is operated to maintain the temperature inside the container 212 such that the polymer in the container will be maintained in the molten or liquid state. It has been found advantageous to employ polymers at such a temperature that the viscosity will be in the range of 90–100 sayboldt seconds. The heater 218 is operated to maintain the upper portion of the container 212 within a temperature range of, for example, 250° C. in the case of low density polyethylene. The bottom portion of the container 212 is heated by means of heating coils 212A regulated through the control 220 connected thereto through a connecting wire 222 to maintain the lower portion of the container 212 within a temperature range of 225°–240° C.

Thus, the polymer or mixture of polymers added to the container 212 is heated from 10–12 hours, whereafter the perfume composition or perfume material consisting of compounds defined according to the structure:

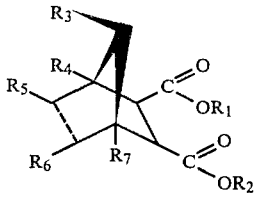

wherein $R_1$ and $R_2$ are the same or different, $C_1$–$C_3$ lower alkyl; wherein one of $R_3$, $R_4$, $R_5$, $R_6$ and $R_7$ is methyl and the other of $R_3$, $R_4$, $R_5$, $R_6$ and $R_7$ is hydrogen; and wherein the dashed line represents a carbon-carbon single bond or a carbon-carbon double bond is quickly added to the melt. Generally, about 10–45 percent by weight of the resulting mixture of the perfumery substance is added to the polymer.

After the perfume material is added to the container 212 the mixture is stirred for a few minutes, for example, 5–15 minutes and maintained within the temperature ranges indicated previously by the heating coil 212A. The controls 216 and 220 are connected through cables 224 and 226 to a suitable supply of electric currents for supplying the power for heating purposes.

Thereafter, the valve "V" is opened permitting the mass to flow outwardly through conduit 232 having a multiplicity of orifices 234 adjacent to the lower side thereof. The outer end of the conduit 232 is closed so that the liquid polymer intimately admixed with the perfume substance defined according to the structure:

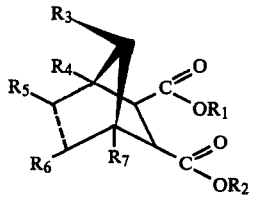

or mixture containing said perfume substance will continuously drop through the orifices 234 downwardly from the conduit 232. During this time, the temperature of the polymer intimately admixed with the perfumery substance in the container 212 is accurately controlled so that a temperature in the range of from about 240°–250° C. (in the case of low density polyethylene) will exist in the conduit 232. The regulation of the temperature through the control 216 and 220 is essential in order to insure temperature balance to provide for the continuous dropping or dripping of molten polymer intimately admixed with the perfume material defined according to the structure:

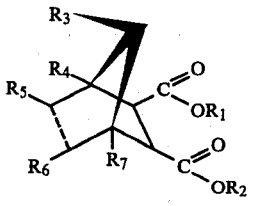

through the orifices 234 at a range which will insure the formation of droplets 236 which will fall downwardly onto a moving conveyor belt 238 caused to run between conveyor wheels 240 and 242 beneath the conduit 232.

When the droplets 236 fall onto the conveyor 238, they form pellets 244 which harden almost instantaneously and fall off the end of the conveyor 238 into a container 250 which is advantageously filled with water or some other suitable cooling liquid to insure the rapid cooling of each of the pellets 244. The pellets 244 are then collected from the container 250 and utilized for formation of other functional products, e.g., carbage bags and the like.

THE INVENTION

It has now been discovered that novel solid and liquid perfume compositions, colognes and perfumed articles (e.g., solid or liquid anionic, cationic, nonionic or zwitterionic detergents, fabric softeners, drier-added fabric softener articles, hair preparations and perfumed polymers) having intense and long lasting earthy, green, cucumber, violet, spicy (peppery), woody, fruity, floral, tropical rain forest-like, and morning dew aromas with patchouli, camphoraceous, clove-like, caryophyllene and carnation undertones may be provided by the utilization of one or more substituted norbornane diesters defined according to the generic structure:

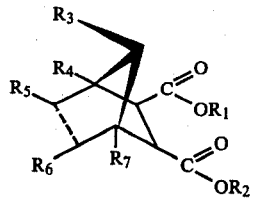

wherein $R_1$ and $R_2$ are the same or different, $C_1$–$C_3$ lower alkyl; wherein one of $R_3$, $R_4$, $R_5$, $R_6$ and $R_7$ is methyl and the other of $R_3$, $R_4$, $R_5$, $R_6$ and $R_7$ is hydrogen; and wherein the dashed line represents a carbon-carbon single bond or a carbon-carbon double bond in perfume compositions, perfumed articles and colognes.

Unless otherwise specified representations herein are intended to indicate "cis" isomers, "trans" isomers, mixtures of "cis" and "trans" isomers and "endo" isomers and "exo" isomers with respect to the norbornane ring moiety and dextro and levorotary isomers as well as racemic mixtures of optical isomers of the norbornane derivatives of our invention.

The ends of our invention useful as indicated, supra, may be produced according to the process as set forth in United Kingdom patent specification No. 578,867 issued on July 15, 1946, the specification for which is incorporated by reference herein or by U.S. Pat. No. 4,357,253 issued on Nov. 2, 1982, the specification for which is incorporated by reference herein.

In summary, cyclopentadiene, methylcyclopentadienes or dimers thereof defined according to the structure:

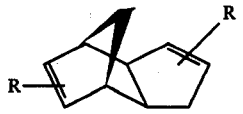

wherein R represents methyl or hydrogen may be reacted with maleic diesters according to the reaction:

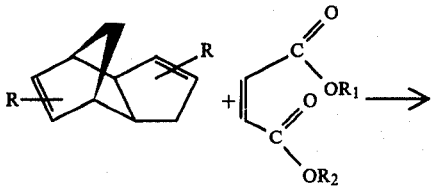

-continued

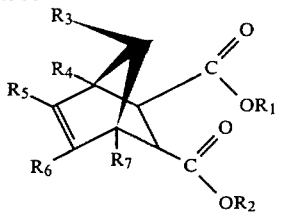

wherein $R_1$ and $R_2$ are the same or different, $C_1$–$C_3$ lower alkyl; wherein one of $R_3$, $R_4$, $R_5$, $R_6$ and $R_7$ is methyl and the other of $R_3$, $R_4$, $R_5$, $R_6$ and $R_7$ is hydrogen; and wherein the dashed line represents a carbon-carbon single bond or a carbon-carbon double bond; the resulting compound defined according to the structure:

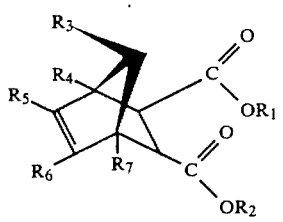

may be separated from the reaction mass and used as is for its organoleptic properties, or it may further be hydrogenated according to the reaction:

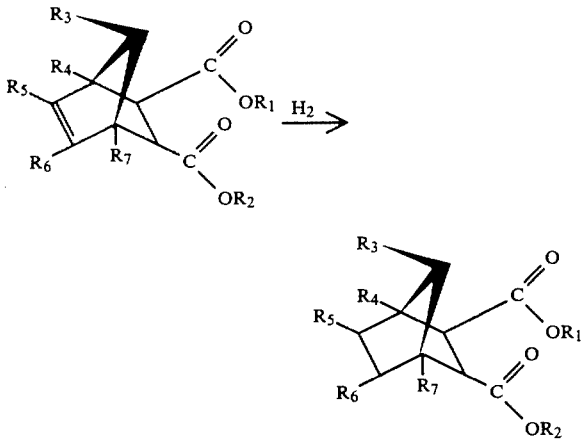

thereby forming a compound which is a member of the genus:

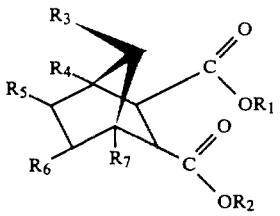

This compound is then isolated in a routine fashion by means of fractional distillation and extraction techniques, and, if desired, the various isomers may be separated by means of standard liquid chromatographic procedures.

Examples of the compound useful in our invention and their organoleptic utilities are as follows:

TABLE I

| Structure of the Compound | Organoleptic Character |
|---|---|
| 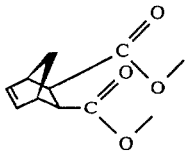 | A green, cucumber, violet, spicy (peppery) aroma with patchouli, camphoraceous, clove-like, caryophyllene-like and carnation nuances on dry out. |
| 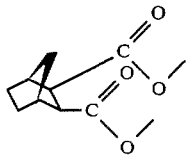 | An earthy, green, woody, fruity, floral, "tropical rain forest-like", morning dew aroma. |
| 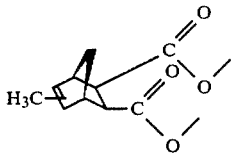 | A green, violet, woody aroma. |

The norbornyl diester(s) and one or more auxiliary perfume ingredients, including, for example, hydrocarbons, alcohols, ketones, aldehydes, nitriles, esters other than the norbornyl diesters of our invention, lactones or cyclic esters, synthetic essential oils and natural essential oils, may be admixed so that the combined odors of the individual components produce a pleasant and desired fragrance, particularly and preferably in earthy, green, cucumber, violet, spicy (peppery), woody, fruity, floral, tropical rain forest-like and morning dew aromas with patchouli, camphoraceous, clove-like, caryophyllene-like and carnation undertones.

Such perfume compositions usually contain (a) the main note or the "bouquet": or foundation stone of the composition; (b) modifiers which round off and accompany the main note; (c) fixatives which include odorous substances which lend a particular note to the perfume throughout all stages of evaporation and substances which retard evaporation; and (d) topnotes which are usually low boiling fresh-smelling materials.

In perfume compositions, it is the individual components which contribute to their particular olfactory characteristics, however the overall sensory effect of the perfume composition will be at least the sum total of the effects of each of the ingredients. Thus, one or more of the norbornyl diester(s) of our invention can be used to alter, modify or enhance the aroma characteristics of a perfume composition, for example, by utilizing or moderating the olfactory reaction contributed by another ingredient in the composition.

The amount of norbornyl diesters of our invention which will be effective in perfume compositions as well as perfumed articles and colognes depends on many factors, including the other ingredients, their amounts and the effects which are desired. It has been found that perfume compositions containing as little as 0.01% of the norbornyl diesters of our invention or even less (e.g., 0.005%) can be used to impart an earthy, green, cucumber, violet, spicy (peppery), woody, fruity, floral, tropical rain forest-like and morning dew aromas with patchouli, camphoraceous, clove-like, caryophyllene and carnation undertones to soaps, detergents (including anionic, nonionic, cationic or zwitterionic solid or liquid detergents), cosmetics, fabric softeners, drier-added fabric softener articles, fabric whiteners, optical brighteners and perfumed polymers. The amount employed can range up to 70% of the fragrance components and will depend on considerations of cost, nature of the end product, the effect desired on the finished product and the particular fragrance sought.

The norbornyl diesters of our invention are useful (taken alone or together with other ingredients in perfume compositions) in detergents and soaps, space odorants and deodorants, perfumes, colognes, toilet water, bath preparations, such as lacquers, brilliantines, pomades and shampoos; cosmetic preparations, such as creams, deodorants, hand lotions and sun screens; powders such as talcs, dusting powders, face powders and the like. As little of 0.005% of the norbornyl diester(s) (in the ultimate perfumed article) will suffice to impart an earthy, green, cucumber, violet, spicy (peppery), woody, fruity, floral, tropical rain forest-like, morning dew aroma with patchouli, camphoraceous, clove-like, caryophyllene-like and carnation undertones to various types of perfumed articles. Generally, no more than 3% of the norbornyl diester(s) based on the ultimate end product (perfumed article) is required. Thus, the range in perfumed articles of use of the norbornyl diester(s) of our invention are from about 0.005% up to about 3% by weight of the ultimate perfumed article.

In addition, the perfume composition or fragrance composition of our invention can contain a vehicle, or carrier for the norbornyl diester(s). The vehicle can be a liquid such as a non-toxic alcohol, e.g., ethyl alcohol, a non-toxic glycol, e.g., propylene glycol or the like. The carrier can also be an absorbent solid, such as a gum (e.g. gum arabic, xanthan gum or guar gum), or components for encapsulating the composition (such as gelatin by means of coacervation or such as a urea formaldehyde polymer when forming a polymer wall around a liquid perfume center).

Our invention also relates to the utilization of controlled release technology for the controlled release of perfumes into gaseous environments from polymers such as mixtures of epsilon polycaprolactone polymers and polyethylene which poly epsilon caprolactone polymers are defined according to at lease one of the structures:

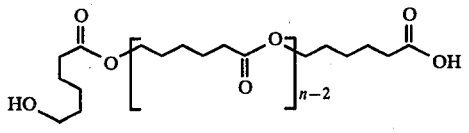

and/or

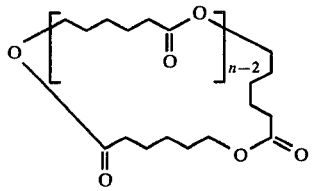

wherein "n" is from about 50 up to about 1,200 with the proviso that the average "n" in the system varies from about 150 up to about 700 according to the mathematical statement:

$$[700 \geqq \bar{n} \geqq 150]$$

with the term $\bar{n}$ being the average number of repeating monomeric units for the epsilon polycaprolactone polymer. The perfumed material's release rate from such polymer mixture is close to "zero order". As a general rule, the release rate in a polymeric matrix is proportional to $t^{-\frac{1}{2}}$ until about 60% of the functional fluid is released from the polymeric matrix. The release rate thereafter is related exponentially to time as a general rule according to the equation:

$$\frac{dM_t}{dt} = k_1 e^{-k_2 t}$$

wherein $k_1$ and $k_2$ are constants. According to Kydonieus, "Controlled Release Technologies:Methods, Theory, and Applications" (cited, supra), the amount of functional fluid released system which are describable as physically dispersed nonerodible polymeric or elastomeric matrices is proportional to time as long as the concentration of functional fluid present (dispersed and dissolved) is higher than the solubility of the agent in the matrix. Thus, such dispersed systems are similar to the dissolved systems except that instead of a decreased release rate after 60% of the functional fluid has been emitted, the relationship holds almost over the complete release curve. Kydonieus further states, that if one assumes that the release of functional fluid by diffusion is negligible in monolithic erodible systems, the speed of erosion will control the release rate and release by erosion by a surface-area-dependent phenomenon, the release being constant (zero order) as long as the surface area does not change during the erosion process. This is the case with the polymers containing the genus defined according to the structure:

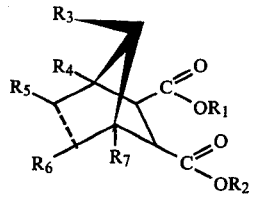

wherein $R_1$ and $R_2$ are the same or different, $C_1$–$C_3$ lower alkyl; wherein one of $R_3$, $R_4$, $R_5$, $R_6$ and $R_7$ is methyl and the other of $R_3$, $R_4$, $R_5$, $R_6$ and $R_7$ is hydrogen; and wherein the dashed line represents a carbon-carbon single bond or a carbon-carbon double bond.

The polyepsilon caprolactone polymers useful in practicing our invention are more specifically described in the brochure of the Union Carbide Corporation, 270 Park Avenue, New York, N.Y. 10017, entitled "NEW POLYCAPROLACTONE THERMOPLASTIC POLYMERS PCL-300 AND PCL-700". These polyepsilon caprolactone polymers are composed of a repeating sequence of non-polar methylene groups and relatively polar ester groups. The average number of repeating momomeric units varies between 150 and 700 depending on the particular "PCL" number. Thus, regarding PCL-300 the average number of repeating monomeric units is about 300. Regarding PCL-700, the average number of repeating monomeric units is 700.

The polyepsilon caprolactone homopolymers which are ultimately taken in admixture with such materials as polyethylene useful in the practice of our invention may also be stabilized using stabilizers as defined in U.S. Pat. No. 4,360,682 issued on Nov. 23, 1982, the specification for which is incorporated herein by reference. The stabilizing materials which stabilize the polyepsilon caprolactone useful in conjunction with our invention against discoloration are dihydroxybenzenes such hydroquinone or compounds having the formula:

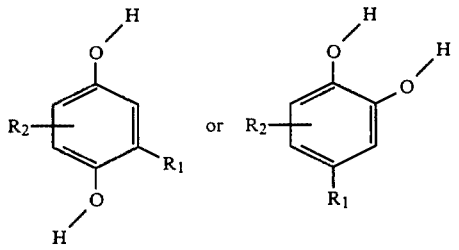

in which $R_1$ is alkyl of from 1 to 8 carbon atoms, and $R_2$ is hydrogen or alkyl of 1 to 8 carbon atoms. It is preferable to have such stabilizer in the polyepsilon caprolactone homopolymer in an amount of from about 100 to 500 ppm. Such stabilizers do not interfer with the functional fluids dissolved and/or adsorbed into the polymeric matrix.

The method of incorporating the compound having the structure:

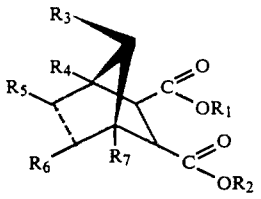

wherein $R_1$ and $R_2$ are the same or different, $C_1$–$C_3$ lower alkyl; wherein one of $R_3$, $R_4$, $R_5$, $R_6$ and $R_7$ is methyl and the other of $R_3$, $R_4$, $R_5$, $R_6$ and $R_7$ is hydrogen; and wherein the dashed line represents a carbon-carbon single bond or a carbon-carbon double bond; or perfume compositions containing same into the polymers may be according to this technique, for example, U.S. Pat. No. 3,505,432 issued on Apr. 7, 1970 (the specification for which is incorporated by reference herein), or U.S. Pat. No. 4,247,498 issued on Jan. 27, 1981, the disclosure of which is incorporated by reference herein.

This, for example, a first amount of liquified polyethylenepolyepsilon caprolactone polymer mixture (50:50) is mixed with a perfume material such as compound having the structure:

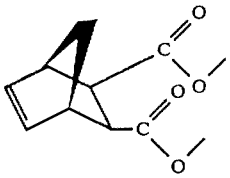

Drops are formed from the mixture and the drops are solidified. The solidified drops are then melted, if desired, with a second amount of unscented low density polyethylene, for example, or polypropylene, for example. Usually, but not necessarily, the second amount of polymer is larger than the first amount. The resulting mixture thus obtained is solidified subsequent to or prior to ultimate casting into a utilitarian shape.

Thus, in accordance with one aspect of our invention the imparting of scent is effected in two stages. In a first stage, a 50:50 (weight:weight) polyepsilon caprolactone, e.g., PCL-700: polyethylene in molten form is admixed with a high percentage of scent imparting material having the structure:

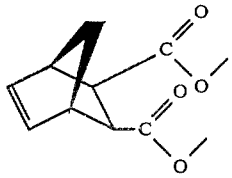

for example, and the mixture is solidified in the form of pellets or beads. These pellets or beads thus contain a high percentage of material having the structure:

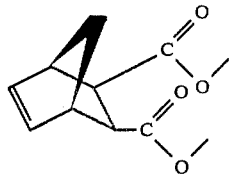

(e.g., up to 40% by weight of the entire mixture) and may be used as "master pellets" which thereafter, in a second stage, if desired, may be admixed and liquified with additional polymers such as additional polyethylene or mixtures of polyethylene and polyepsilon caprolactone in an unscented state, or unscented polypropylene. In addition, additional polymers or copolymers may be used, for example, copolymers specified and described in United Kingdom patent specification No. 1,589,201 published on May 7, 1981, the specification for which is incorporated by reference herein.

In accordance with the present invention the aroma containing material, for example, that having the structure:

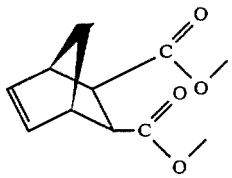

is added to the polymer in a large closed container or drum which is maintained under controlled temperature conditions while the polymer in a melted condition is mixed with the perfume material under agitation.

In order that the perfume be added uniformly to the polymer, the temperature of the melt is constantly controlled during the process. The polymer-perfume mixture is then directed through an elongated conduit or pipe element having a plurality of orifices adjacent to the lower most portion thereof. The polymer enriched by the perfume is permitted to drip through the orifices onto a continuously moving, cooled conveyor upon which the polymer containing the perfume solidifies into small size pellets with the perfume imprisoned therein. The apparatus useful in conjunction with this process advantageously includes a conveyor of a material which will not adhere to the polymer which contains the perfume. In order that the droplets form into uniform pellets or beads, the conveyor is continuously washed with a liquid such as water to maintain the surface relatively cool. The pellets are delivered by the conveyor into a container and packaged for shipment.

The following examples serve to illustrate processes for producing the norbornyl diesters of our invention (Examples I, II and III) as well as processes for utilizing the norbornyl diesters of our invention for their organoleptic utilities (Examples IV, et seq).

All parts and percentages given herein are by weight unless otherwise specified.

EXAMPLE I

PREPARATION OF THE DIMETHYL ESTER OF 5-METHYL-5-NORBORNENE-2,3-DICARBOXYLIC ACID

Reaction:

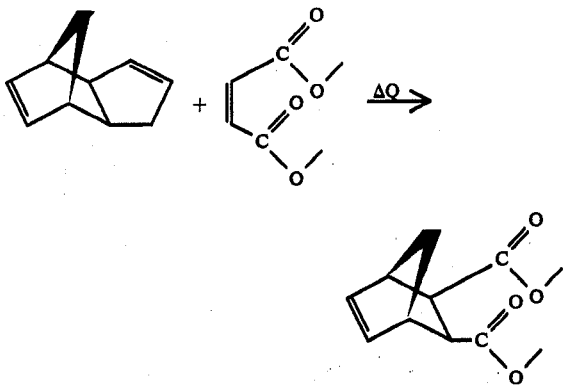

132 Grams of dicyclopentadiene (1 mole) is heated in an autoclave with 216 grams (1.5 moles) of dimethyl maleate. The contents are added to the autoclave (a 1-liter autoclave) and the autoclave is sealed and pressurized to 15 atmospheres and heated to a temperature of 150° C. at constant temperature and pressure for a period of five hours. At the end of the five hour period, the autoclave is cooled, opened and the contents are then removed and distilled on a 2" splash column, yielding the following fractions:

| Fraction No. | Vapor Temp. (°C.) | Liquid Temp. (°C.) | Vacuum mm. Hg. Pressure | Reflux Ratio |
|---|---|---|---|---|
| 1 | 114 | 132 | 4.8 | 9:1 |
| 2 | 115 | 133 | 4.8 | 9:1 |
| 3 | 115 | 134 | 4.8 | 9:1 |
| 4 | 116 | 135 | 4.8 | 9:1 |
| 5 | 116 | 138 | 4.8 | 2:1 |
| 6 | 116 | 144 | 4.8 | 2:1 |
| 7 | 116 | 155 | 4.8 | 2:1 |
| 8 | 116 | 184 | 4.8 | 2:1 |
| 9 | 135 | 205 | 4.8 | 2:1 |
| 10 | 169 | 220 | 4.8 | 2:1 |

The resulting product has a GLC profile as set forth in FIG. 1 (conditions: SE 30 column programmed at 220° C. isothermal). The peak indicated by reference numeral "10" on the GLC profile is the peak for the compound defined according to the structure:

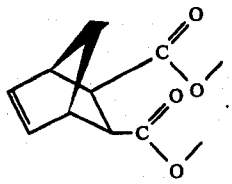

EXAMPLE II

PREPARATION OF THE DIMETHYL ESTER OF 2,3-NORBORNANE DICARBOXYLIC ACID

EXAMPLE II-A

Reaction:

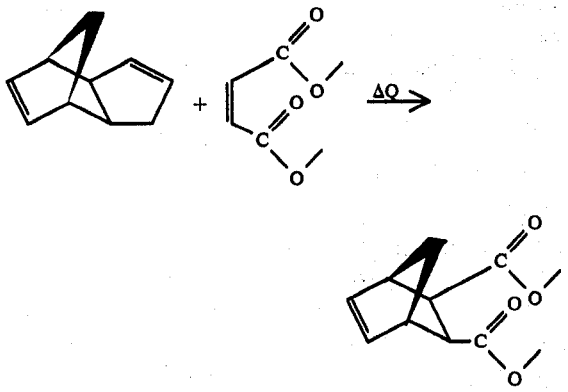

EXAMPLE II-B

Reaction:

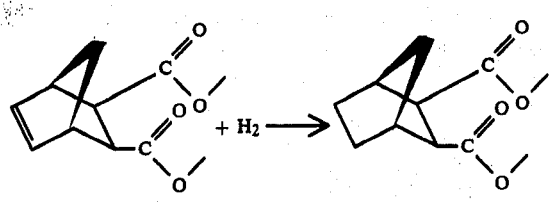

Into a 2-liter Parr autoclave are placed 198 grams of dicyclodipentadiene (1.5 moles) and 432 grams of dimethyl maleate (3 moles). The autoclave is sealed and heated to 150°-200° C. for a period of one hour. At the end of the one hour period, the autoclave is cooled and the contents are removed for the next aspect of this example (606 grams yield).

EXAMPLE II-B

Into a 2-liter par autoclave equipped with hydrogen feed is placed 600 grams of the dicyclopentadiene-dimethyl maleate adduct produced according to Example II-A (3.17 moles) and 3 grams of a 5% palladium on carbon catalyst and 300 ml isopropyl alcohol.

The autoclave is sealed and hydrogen is added to the autoclave to a pressure of 10 atmospheres. The reaction is maintained keeping a pressure of 10 atmospheres hydrogen pressure for a period of four hours. At the end of the four hour period, the autoclave is opened and the reaction product is distilled yielding the following fractions:

| Fraction No. | Vapor Temp. (°C.) | Liquid Temp. (°C.) | Vacuum mm. Hg. Pressure | Reflux Ratio |
|---|---|---|---|---|
| 1 | 58/85 | 136/ | 5 mm | 1:1 |
| 2 | 85 | 116 | 5 mm | 4:1 |
| 3 | 85 | 117 | 1.6 | 4:1 |
| 4 | 85 | 118 | 1.6 | 4:1 |
| 5 | 85 | 118 | 1.6 | 4:1 |
| 6 | 85 | 118 | 1.6 | 4:1 |
| 7 | 85 | 118 | 1.6 | 4:1 |
| 8 | 85 | 125 | 1.6 | 4:1 |
| 9 | 84 | 163 | 1.6 | 4:1 |
| 10 | 83 | 225 | 1.6 | 4:1 |

FIG. 2 is the GLC profile for the crude reaction product (initial reaction sample) of Example II-A containing the compound having the structure:

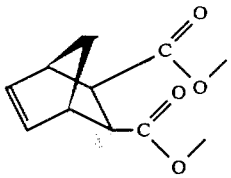

(conditions: S.E. 30, column programmed at 180° C. isothermal).

FIG. 3 is the GLC profile for the crude reaction product prior to hydrogenation (conditions: S.E. 30, column programmed at 180° C. isothermal).

FIG. 4 is the GLC profile for the crude reaction product of Example II-B containing the compound having the structure:

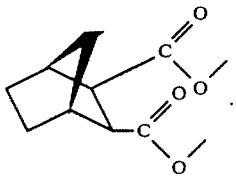

(Conditions: S.E. 30, column programmed at 180° C. isothermal).

EXAMPLE III

PRODUCTION OF DIMETHYL MALEATE-METHYL CYCLOPENTADIENE ADDUCT

Reaction:

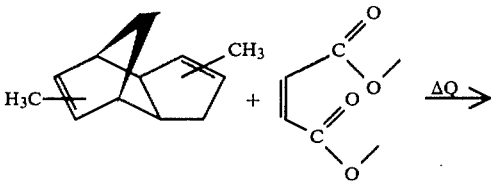

-continued

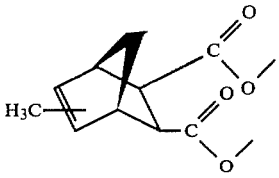

Into a 2-liter autoclave is placed 416 grams (2.6 moles) of methyl cyclopentadiene dimer and 516 grams (4 moles) of dimethyl maleate. The autoclave is sealed and heated to 180°–225° C. at a pressure of 10 atmospheres. The autoclave is maintained at a pressure of 10 atmospheres and temperature of 225° C. for a period of two hours. At the end of the two hour period, the autoclave is cooled and opened.

The contents of the autoclave are distilled on 12" Goodloe column yielding the following fractions:

| Fraction No. | Vapor Temp. (°C.) | Liquid Temp. (°C.) | Vacuum mm. Hg. Pressure | Reflux Ratio |
|---|---|---|---|---|
| 1 | 45/75 | 130/121 | 3 mm | 3:1 |
| 2 | 97 | 125 | 3 mm | 9:1 |
| 3 | 97 | 124 | 3 mm | 9:1 |
| 4 | 97 | 124 | 3 mm | 9:1 |
| 5 | 92 | 124 | 9 mm | 1:1 |
| 6 | 92 | 127 | 9 mm | 1:1 |
| 7 | 92 | 128 | 9 mm | 1:L |
| 8 | 92 | 129 | 9 mm | 1:1 |
| 9 | 98 | 131 | 9 mm | 1:1 |
| 10 | 105 | 136 | 2.0 | 1:1 |
| 11 | 97 | 133 | 0.8 | 1:1 |
| 12 | 97 | 138 | 0.8 | 1:1 |
| 13 | 95 | 145 | 0.9 | 1:1 |
| 14 | 95 | 159 | 0.9 | 1:1 |
| 15 | 95 | 178 | 1.0 | 1:1 |
| 16 | 66 | 200 | 1.0 | 1:1 |

The resulting reaction product is a mixture of compounds defined according to the structure:

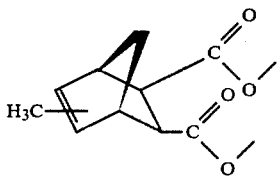

wherein on the norbornyl moiety the methyl moiety is at various positions in each of the molecules of the mixture.

FIG. 5 is the GLC profile for the reaction product for the crude reaction product prior to distillation. The peak indicated by reference numeral "50" is the peak for the mixture of compounds defined according to the structure:

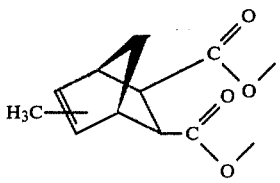

The peak indicated by reference numeral "51" is the peak for the mixture of dimethyl dicyclopentadiene dimers.

EXAMPLE IV

The following spicy, floral and herbal type formulae are prepared:

| Ingredients | Parts By Weight IV(A) | IV(B) | IV(C) |
|---|---|---|---|
| Geranium Bourbon | 20.0 | 20.0 | 20.0 |
| Rosemary Oil Spanish | 10.0 | 10.0 | 10.0 |
| Lavender Oil Barreme | 10.0 | 10.0 | 10.0 |
| Thyme Oil White | 10.0 | 10.0 | 10.0 |
| Amyl Cinnamic Aldehyde | 10.0 | 10.0 | 10.0 |
| Sauge Sclaree French | 5.0 | 5.0 | 5.0 |
| Sandalwood Oil | 5.0 | 5.0 | 5.0 |
| Galbanum Oil | 5.0 | 5.0 | 5.0 |
| Patchouli Oil Light | 5.0 | 5.0 | 5.0 |
| Cedarwood Oil Light | 15.0 | 15.0 | 15.0 |
| Product Produced according to Example I, consisting of the compounds defined according to the structure: 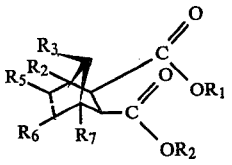 | 5.0 | — | — |
| The compound produced according to Example II-B consisting of the compound having the structure: 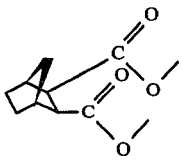 | — | 5.0 | — |
| The compound having the structure: 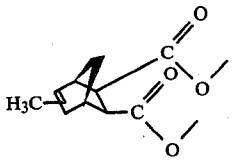 | — | — | 5.0 |
| Produced according to Example III | | | |

When the composition of matter prepared according to Example I is added into this formula, a green, cucumber, violet, spicy nuance is added to this spicy, floral and herbal formula. The overall composition can be described from an organoleptic standpoint as "spicy, floral and herbal aroma with intense green, cucumber and violet topnotes and patchouli, camphoraceous, clove-like, caryophyllene-like and carnation-like undertones".

In formulation IV(B), the compound having the structure:

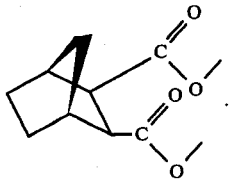

imparts an interesting, earthy, green, woody, fruity, floral, "tropical rain forest", morning dew aroma profile to this spicy, floral and herbal formulation. The overall formulation of Example IV(B) can be described as "spicy, floral and herbal with earthy, green, woody, fruity, 'tropical rain forest', morning dew undertones".

Insofar as Example IV(C) is concerned, the compound defined according to the structure:

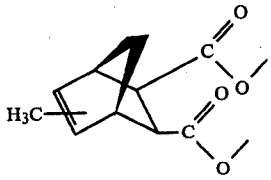

imparts an interesting, green, violet, woody aroma profile to the spicy, floral and herbal formulation. Accordingly, the formulation can be described as "spicy, floral, herbal with green, violet and woody undertone".

EXAMPLE V

A stable lotion is prepared with the following formulation:

| Ingredients | Parts by Weight |
|---|---|
| poly(N,N—dimethyl-3,5-dimethylene piperidinium chloride) (Merquat 100, Merck & Co., U.S.A., average molecular weight 50,000–100,000, viscosity in 40% aqueous solution, 10,000 cps. | 1.0 |
| cocoamidopropyl dimethyl glycine (betaine) | 5.7 |
| myristyl dimethylamine oxide | 12.0 |
| stearic monoethanolamide opacifier | 2.0 |
| perfume material as indicated in Table II (below) giving rise to the aroma profiles as indicated in Table II (below) | 0.5 |
| water, colour, salts, U.V. absorber | q.s. to 100 |

Two or three bottle capfuls of the above lotion held under the tap releasing the water into the bathtub yields a copiously foamed bubble bath with no visible precipitation, flocculation, or "bathtub ring" even using hard water. Bathing in this bath is found to have a cleansing and pleasing emollient effect on the skin as described above.

When, after immersion in this bath, the body is soaped, rinsed and dried, an even better, more long-lasting emollient, moisturizing effect on the skin is observed. The foam or bubbles are substantially unaffected by the soaping step, and no precipitate, flocculate or "bathtub ring", or any bothersome film or coating on the bathtub surface is found.

The aroma produced is as set forth in Table II, below:

TABLE II

| Product | Aroma Profile |
|---|---|
| The compound having the structure: 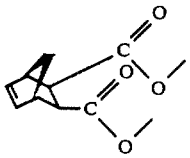 prepared according to Example I. | A green, cucumber, violet, spicy (peppery) aroma with patchouli, camphoraceous, clove-like, caryophyllene-like and carnation nuances on dry out. |
| The compound having the structure: 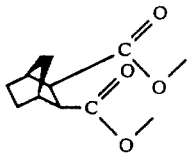 produced according to Example II-B. | An earthy, green, woody, fruity, floral, "tropical rain forest-like", morning dew aroma. |
| The mixture of compounds having the structure: 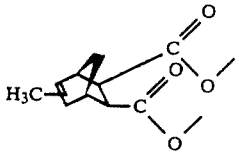 produced according to Example III. | A green, violet, woody aroma. |
| Perfume formulation of Example IV-A | A spicy, floral and herbal aroma with intense green, cucumber and violet topnotes and patchouli, camphoraceous, clove-like, caryophyllene-like and carnation-like undertones. |
| Perfume formulation of Example IV-B | Spicy, floral and herbal with earthy, green, woody, fruity, "tropical rain forest", morning dew undertones. |
| Perfume formulation of Example IV-C | Spicy, floral, herbal with green, violet and woody undertone. |

EXAMPLE VI

SHAMPOO

The following shampoo is prepared containing the following ingredients:

| Ingredients | Parts by Weight |
|---|---|
| Tridecyloxy polyethoxy ethanol of ten ethoxy groups | 17.3 |
| Polyoxyethylene (20) sorbitan monolaurate | 7.5 |
| Myristyl dimethylamine oxide (30% active) | 25.0 |
| $C_{10}$–$C_{20}$ fatty acyl monoethanolamide (cocomonoethanolamide) | 2.5 |
| Polyacrylamide of molecular weight of about 1,500,000 | 0.2 |
| Hydrogen peroxide (30% aqueous solution) | 0.5 |
| Perfume ingredient as indicated at Table II of Example V giving rise to aroma profile as indicated in Table II of Example V. | 1.0 |
| Deionized water (3 micromhos/cm | 46.0 |

-continued

| Ingredients | Parts by Weight |
|---|---|
| conductivity) | |

A shampoo of the above composition is made in the following manner. First, the tridecyloxy polyethoxy ethanol is added to a clean mixing tank, with the agitator on, and the amine oxide, polyoxyethylene sorbitan monolaurate and cocomonoethanolamine are added sequentially, with continued agitation. The mix is then heated to 68° C., until the cocomonoethanolamide is melted and/or dissolved. The hydrogen peroxide solution is then admixed with the mentioned nonionics and mixing is continued for about half an hour, in which the peroxide destroys any free amines or other harmful impurities that may be present. The mix is then cooled to 38° C.

In a separate mixer the polyacrylamide is gradually added to the formula weight of deionized water, with the mixer on. Addition is effected carefully and slowly (the polyacrylamide is sprinkled in) to avoid the production of "fish eyes" in the mix. After dissolving of the polyacrylamide the solution thereof is added to the first mixing tank with agitation and is blended with the nonionics, such mixings being at room temperature. Subsequently the perfume as indicated in Table II of Example V, supra, giving rise to the aroma profile as set forth in Table II of Example V, supra, is admixed with the balance of the composition and mixing is continued for another half hour.

The product made is an excellent shampoo of satisfactory viscosity and aroma, foaming power, foam stability, low conductivity and good shampooing effects. The viscosity is about 1,000 centipoises at 20° C. and the conductivity, using the Hach Conductivity Meter, is 750 micromhos/cm. The foaming power is 250 ml and the foam stability is 22 seconds, by the test method previously described. In comparison, a commercial shampoo based on triethanolamine lauryl sulphate detergent has a conductivity of about 22,000 micromhos/cm, a viscosity of about 1,500 centipoises, a foaming power of about 380 ml and a foam stability of 60 seconds.

In panel evaluations of the experimental shampoo compared to a different commercial product, in actual shampooing, the experimental formula was adjudged significantly better in being less drying, producing a softer feel for the wet hair, leaving the wet hair easier to comb, being less prone to accumulate static charges (less flyaway) and having a foam of better appearance and feel. Additionally, the experimental product was judged better in almost all hair effect properties, with the control only being about equal to it in curl retention. In properties other than those mentioned the experimental product was better in rinsability, the control was better in foam build-up rate and the foams were about equal in volume and stability.

In the shampooing described herein and in subsequent Examples the human hair is washed on the head by wetting the hair with warm tap water at about 42° C., applying 15 grams of shampoo to the hair, lathering it into the hair for a minute, rinsing with warm tap water for 30 seconds, re-lathering with 7 grams of shampoo for a minute and rinsing off for 30 seconds, after which the hair is towel-dried and dried further with an automatic hair dryer.

EXAMPLE VII

FABRIC FRESHENER COMPOSITION

A fabric freshener composition is prepared as follows:

| Ingredients | Parts by Weight |
|---|---|
| Sodium bicarbonate | 3.0 |
| "Kyro" EOB (Trademark)* | 1.0 |
| Perfume ingredient as set forth in Table II of Example V giving rise to an aroma as set forth in Table II of Example V | 1.0 |
| Water | 0.05 |

The composition of this Example is prepared by simply mixing the ingredients.

The above described composition is applied a lightly soiled and wrinkled fabric as droplets (ca. 5.0 mm avg. size) using a trigger action sprayer having a nozzle which is adjustable to provide composition droplets in the desired range. The composition is applied at a rate of about 1 gram of composition to about 10 grams of fabric.

The fabric is then placed in an automatic dryer and dried with tumbling action, at a temperature of 60° C.-80° C. for a period of 15 minutes. The fabric is rendered free of wrinkles and static, and has a fresh appearance and pleasant odor profile as set forth in Table II of Example V, supra. The sodium bicarbonate is not visible on the refreshed fabric.

EXAMPLE VIII

PERFUMED LIQUID DETERGENT

Concentrated liquid detergents (lysine salts of n-dodecyl benzene sulfonic acid as more specifically described in U.S. Pat. No. 3,948,818 issued on Apr. 6, 1976, the specification for which is incorporated by reference herein) with aromas as indicated in Table II of Example V, supra, are prepared containing 0.10%, 0.15%, 0.20%, 0.25%, 0.30%, 0.40%, 0.50% and 0.80% of the perfume ingredient as set forth in Table II of Example V, supra. The detergents are prepared by adding a homogeneously mixing the appropriate quantity of perfume ingredient as set forth in Table II of Example V, supra. The detergents all possess aromas as set forth in Table II of Example V, supra, with the intensity of each increasing with greater concentrations of the perfume ingredient as stated in Table II of Example V, supra.

EXAMPLE IX

PREPARATION OF A COLOGNE AND HANDKERCHIEF PERFUME

The perfume ingredient as set forth in Table II of Example V, supra, are incorporated into colognes at concentrations of 2.0%, 2.5%, 3.0%, 3.5%, 4.0%, 5.0% and 6.0% in 75%, 80%, 85%, 90% and 95% aqueous ethanol solutions. Distinct and definite aromas as set forth in Table II of Example V, supra, are imparted to the colognes. The perfume ingredients as indicated in Table II of Example V, supra, are also added to handkerchief perfumes at concentrations of 15%, 20%, 25%, 30% and 35% (in 75%, 80%, 85%, 90% and 95% aqueous ethanol solutions) and aroma profiles as set forth in Table II of Example V, supra, are imparted to the handkerchief perfume.

EXAMPLE X

PREPARATION OF A DETERGENT COMPOSITION

A total of 100 grams of detergent powder (a low phosphate content detergent composition which contains 12% by weight phosphate builder, 8% hardness mineral ion insensitive detergent, 0.9% by weight maleic anhydride-vinyl compound co-polymer and 2% alkylene oxide condensation product prepared according to Example IV at column IX, U.S. Pat. No. 4,000,080 issued on Dec. 28, 1976, the specification for which is incorporated by reference herein) is intimately admixed with 0.15 grams of one of the perfume materials of Table II of Example V, supra, until a substantially homogeneous composition is obtained. The composition has an aroma as set forth in Table II of Example V, supra.

EXAMPLE XI

Each of the fragranced materials of Table II of Example V, supra, are added to a 50:50 weight:weight mixture of low density polyethylene:polyepsilon caprolactone PCL-700 forming pellets with scents as set forth in Table II of Example V, supra:

75 Pounds of a mixture of PCL-700 polyepsilon caprolactone (manufactured by the Union Carbide Corporation of New York, N.Y. having a melting point of about 180°-190° F.): Low density polyethylene are heated to about 250° C. in a container of the kind illustrated in FIGS. 6 and 7. 25 Pounds of each of the fragrance materials as set forth in Table II of Example V, is then quickly added to the liquified polymer mixture, the lid 228 is put in place and the agitating means 273 are actuated. The temperature is then raised to about 260° F. and the mixing is continued for 5-15 minutes. The valve "V" is then opened to allow flow of the molten polymer enriched with perfume ingredient to exit through the orifices 234. The liquid falling through the orifices 234 solidifies almost instantaneously upon impact with the moving cooled conveyor 238. Polymer beads or pellets 244 having pronounced scents as described in Table II of Example V, supra, are thus formed. Analysis demonstrates that the pellets contain about 25% of the perfume material so that almost no losses in the scenting substance did occur. These pellets may be called "master pellets".

50 Pounds of each batch of the scent containing "master pellets" are then added to one thousand pounds of unscented polypropylene and the mass is heated to the liquid state. The liquid is molded into thin sheets of films. The thin sheets of films have pronounced aromas as set forth in Table II of Example V, supra. The sheets of films are cut into strips of 0.25" in width×3" in length and placed into room air fresheners.

On operation of the room air freshener, after four minutes, the room in each case has an aesthetically pleasing aroma with no foul odor being present, the aroma being described in Table II of Example V, supra.

What is claimed is:

1. A process for augmenting or enhancing the aroma of a consumable material selected from the group consisting of perfume compositions, colognes and perfumed articles comprising the step of adding to said consumable material, an aroma augmenting or enhancing quantity of at least one compound defined according to the structure:

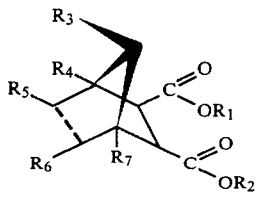

wherein $R_1$ and $R_2$ are the same or different, $C_1$–$C_3$ lower alkyl; wherein one of $R_3$, $R_4$, $R_5$, $R_6$ and $R_7$ is methyl and the other of $R_3$, $R_4$, $R_5$, $R_6$ and $R_7$ is hydrogen; and wherein the dashed line represents a carbon-carbon single bond or a carbon-carbon double bond.

2. A process for augmenting or enhancing the aroma of a consumable material selected from the group consisting of perfume compositions, colognes and perfumed articles comprising the step of adding to a perfume composition, cologne or perfumed article base, an aroma augmenting or enhancing quantity of a composition of matter produced according to the process of reacting a dialkyl maleate with a dicyclopentadiene derivative defined according to the structure:

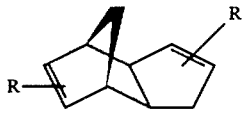

wherein R represents hydrogen or methyl according to the reaction:

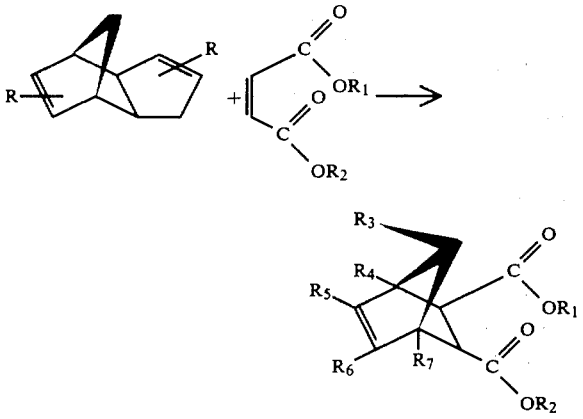

wherein $R_1$ and $R_2$ are the same or different, $C_1$–$C_3$ lower alkyl; wherein one of $R_3$, $R_4$, $R_5$, $R_6$ and $R_7$ is methyl and the other of $R_3$, $R_4$, $R_5$, $R_6$ and $R_7$ is hydrogen; and wherein the dashed line represents a carbon-carbon single bond or a carbon-carbon double bond.

3. The process of claim 2 wherein in the process for producing the reaction product, an additional reaction is carried out, wherein the reaction product is hydrogenated according to the reaction:

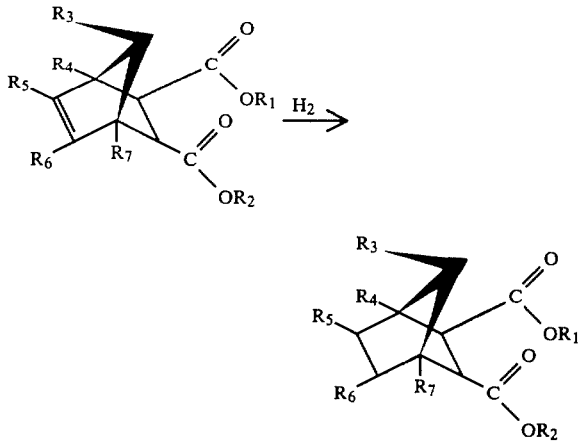

wherein $R_1$ and $R_2$ are the same or different, $C_1$–$C_3$ lower alkyl; wherein one of $R_3$, $R_4$, $R_5$, $R_6$ and $R_7$ is methyl and the other of $R_3$, $R_4$, $R_5$, $R_6$ and $R_7$ is hydrogen; and wherein the dashed line represents a carbon-carbon single bond or a carbon-carbon double bond.

4. The process of claim 1 wherein a consumable material is a perfume composition or cologne.

5. The process of claim 2 wherein a consumable material is a perfume composition or cologne.

6. The process of claim 3 wherein a consumable material is a perfume composition or cologne.

7. The process of claim 1 wherein the consumable material is a perfumed article and the perfumed article is a solid or liquid anionic, cationic, nonionic or zwitterionic detergent.

8. The process of claim 2 wherein the consumable material is a perfumed article and the perfumed article is a solid or liquid anionic, cationic, nonionic or zwitterionic detergent.

9. The process of claim 3 wherein the consumable material is a perfumed article and the perfumed article is a solid or liquid anionic, cationic, nonionic or zwitterionic detergent.

10. The process of claim 1 wherein the consumable material is a perfumed article and the perfumed article is a perfumed polymer.

11. The process of claim 2 wherein the consumable material is a perfumed article and the perfumed article is a perfumed polymer.

12. The process of claim 3 wherein the consumable material is a perfumed article and the perfumed article is a perfumed polymer.

* * * * *